US007316206B2

(12) United States Patent
Akkala et al.

(10) Patent No.: US 7,316,206 B2
(45) Date of Patent: Jan. 8, 2008

(54) WATER HEATER WITH NOISE ATTENUATION

(75) Inventors: Marc W. Akkala, Cedarburg, WI (US); Hyungsik Lee, Port Washington, WI (US)

(73) Assignee: AOS Holding Company, Wilmington, DE (US)

( * ) Notice: Subject to any disclaimer, the term of this patent is extended or adjusted under 35 U.S.C. 154(b) by 343 days.

(21) Appl. No.: 11/110,235

(22) Filed: Apr. 20, 2005

(65) Prior Publication Data

US 2006/0237006 A1 Oct. 26, 2006

(51) Int. Cl.
*F22B 21/26* (2006.01)

(52) U.S. Cl. ..... 122/244; 122/18.1

(58) Field of Classification Search ..... 122/13.01, 122/18.1, 19.1, 169–171, 249, 244, 250 R, 122/250 S See application file for complete search history.

(56) References Cited

U.S. PATENT DOCUMENTS 2,911,957 A 11/1959 Kumm
4,380,215 A 4/1983 Mendelson
4,846,150 A 7/1989 Maton
5,022,352 A * 6/1991 Osborne et al. ..... 122/17.2
5,687,678 A * 11/1997 Suchomel et al. ..... 122/250 R
5,699,756 A 12/1997 Ross et al.
5,735,237 A 4/1998 Phillip et al.
6,036,480 A 3/2000 Hughes et al.
6,810,836 B1 11/2004 Ferguson et al.

FOREIGN PATENT DOCUMENTS

EP 0 926 439 6/1999
JP 56-12949 2/1981
JP 63-129246 6/1988

* cited by examiner

*Primary Examiner*—Gregory Wilson
(74) *Attorney, Agent, or Firm*—Michael Best & Friedrich LLP

(57) ABSTRACT

A water heater comprising a tank defining a water chamber, a water inlet and a water outlet communicating with the water chamber, and a combustion tube extending generally vertically through the water chamber and having an upper end. The water heater also comprises a coil surrounding the combustion tube and having inlet and outlet ends, a second tube communicating between the combustion tube and the inlet end of the coil, and an exhaust outlet communicating with the outlet end of the coil. The water heater further comprises a gas burner firing into the upper end of the combustion tube, and at least one expansion volume between the upper end of the combustion tube and the inlet end of the coil for attenuating noise.

25 Claims, 3 Drawing Sheets

WATER HEATER WITH NOISE ATTENUATION

FIELD OF THE INVENTION

The invention relates generally to water heaters. More specifically, the invention relates to gas-fired commercial water heaters.

BACKGROUND

A known commercial water heater is disclosed in U.S. Pat. No. 6,036,480. This storage-type water heater has a combustion burner at the top of a vertical combustion tube. A snorkel extends upward from the bottom of the combustion tube, and a coil extends downward from the top of the snorkel around the snorkel and the combustion tube. The combustion tube, snorkel and coil are all located within the water tank for transferring heat to the water. This type of water heater is sold by A. O. Smith Corporation under the trademark CYCLONE.

SUMMARY

The invention provides a water heater comprising a tank defining a water chamber for communication with a water inlet and a water outlet, and a combustion tube extending generally vertically through the water chamber and having an upper end. The water heater also comprises a coil surrounding the combustion tube and having inlet and outlet ends, a second tube communicating between the combustion tube and the inlet end of the coil, and an exhaust outlet communicating with the outlet end of the coil. The water heater further comprises a gas burner firing into the upper end of the combustion tube, and at least one expansion volume between the upper end of the combustion tube and the inlet end of the coil for attenuating noise.

Other features and advantages of the invention will become apparent to those skilled in the art upon review of the following detailed description, claims, and drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. The terms "connected," "coupled," and "mounted" and variations thereof herein are used broadly and, unless otherwise stated, encompass both direct and indirect connections, couplings, and mountings. In addition, the terms connected and coupled and variations thereof herein are not restricted to physical and mechanical connections or couplings.

Figure 1:
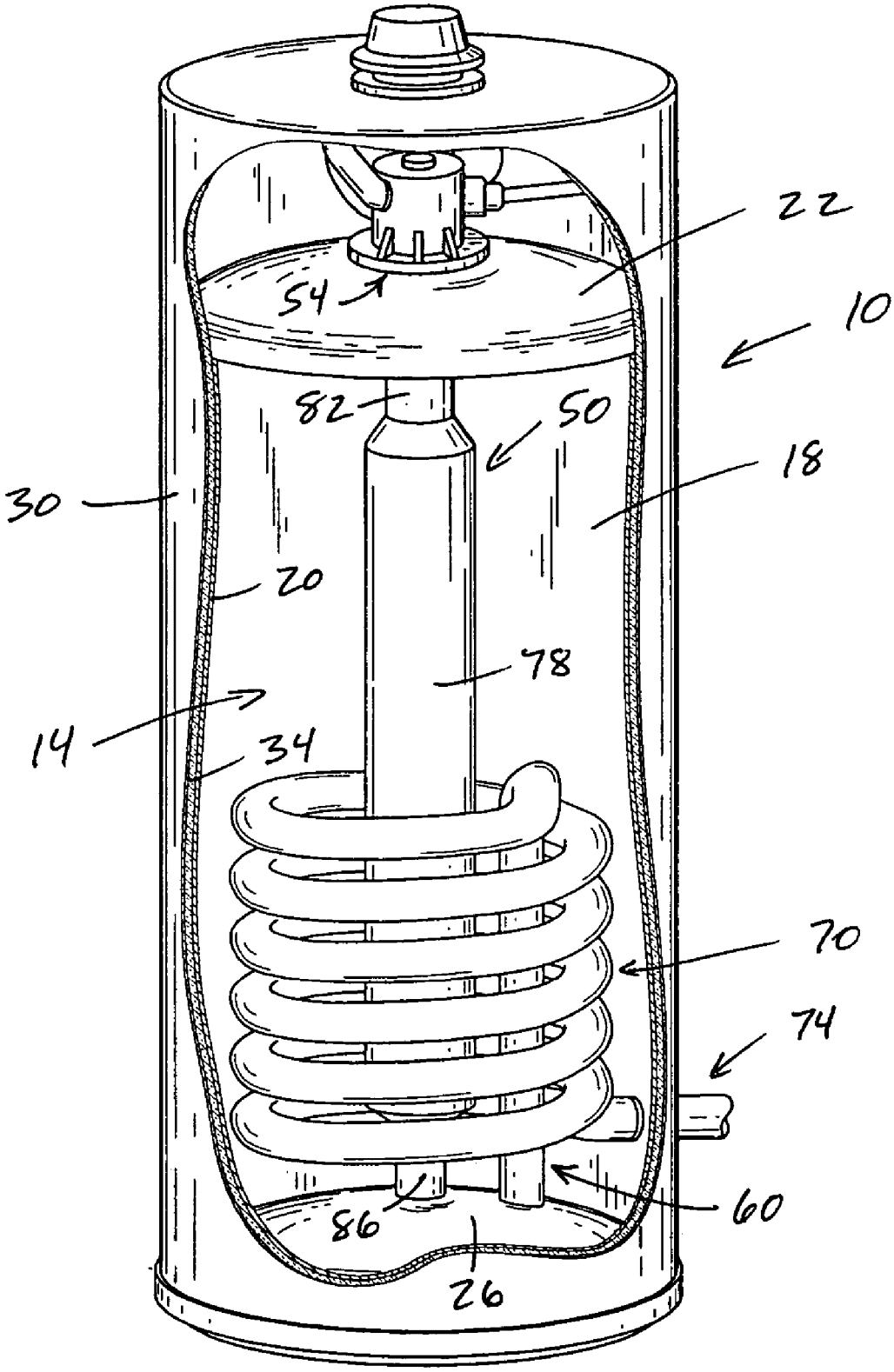
FIG. 1 is a perspective view, partially in section, of a water heater embodying aspects of the invention.

FIG. 1 shows a water heater 10 embodying the invention. Except as described below, the water heater 10 is substantially identical to the water heater disclosed in U.S. Pat. No. 6,036,480, which is incorporated herein by reference.

The water heater 10 comprises a water storage tank 14 defining a water chamber 18. As is known in the art, the tank 14 includes a cylindrical shell 20 with upper and lower ends closed by top and bottom heads 22 and 26, respectively. The tank 14 is surrounded by an outer jacket 30, with a layer of insulation 34 between the shell 20 and the jacket 30. A cold water inlet and a hot water outlet (not shown) communicate with the water chamber 18.

A heat exchanger for transferring heat to water in the chamber 18 includes a combustion tube 50 extending generally vertically through the chamber 18. A gas burner 54 mounted on the top head 22 fires downward into the top of the combustion tube 50. Communicating with the lower end of the combustion tube 50, in a manner described below, is a snorkel tube 60. The lower end of the snorkel tube 60 communicates with the lower end of the combustion tube 50. In the preferred embodiment of the invention, the snorkel tube 60 is circular in cross-section and has a height of approximately 29 inches and a diameter of approximately 2.5 inches.

The heat exchanger also includes a coil 70 surrounding the lower portion of the tube 50. The upper end of the coil 70 communicates with the upper end of the snorkel tube 60, and the lower end of the coil 70 communicates with an exhaust outlet 74. In the preferred embodiment of the invention, the tube of the coil 70 is circular in cross-section and has a diameter of approximately 2.5 inches.

In accordance with the invention, the heat exchanger has a construction that attenuates the noise generated by the gas burner 54. In the embodiment illustrated in FIGS. 1 and 2, the heat exchanger is provided with a number of chambers that create a flow path that allows expansion of combustion gases and reduces transmitted noise by damping and canceling components of the noise.

The combustion tube 50 has an enlarged central or expansion portion 78, a reduced upper portion or end 82 and a reduced lower portion or end 86. Preferably, the upper portion 82 has a cross-sectional area less than that of the central portion 78, and the lower portion 86 has a cross-sectional area less than that of the upper portion 78. Specifically, in the preferred embodiment of the invention, the tube 50 is circular in cross-section, the upper end 82 has a length of approximately six inches and a diameter of approximately five inches, the central portion 78 has a length of approximately 44.5 inches and a diameter of approximately eight inches, and the lower end 86 has a length of approximately four inches and a diameter of approximately 3.5 inches. The overall tube 50 is preferably about 56.5 inches long. The central portion 78 defines a chamber as described above.

Figure 2:
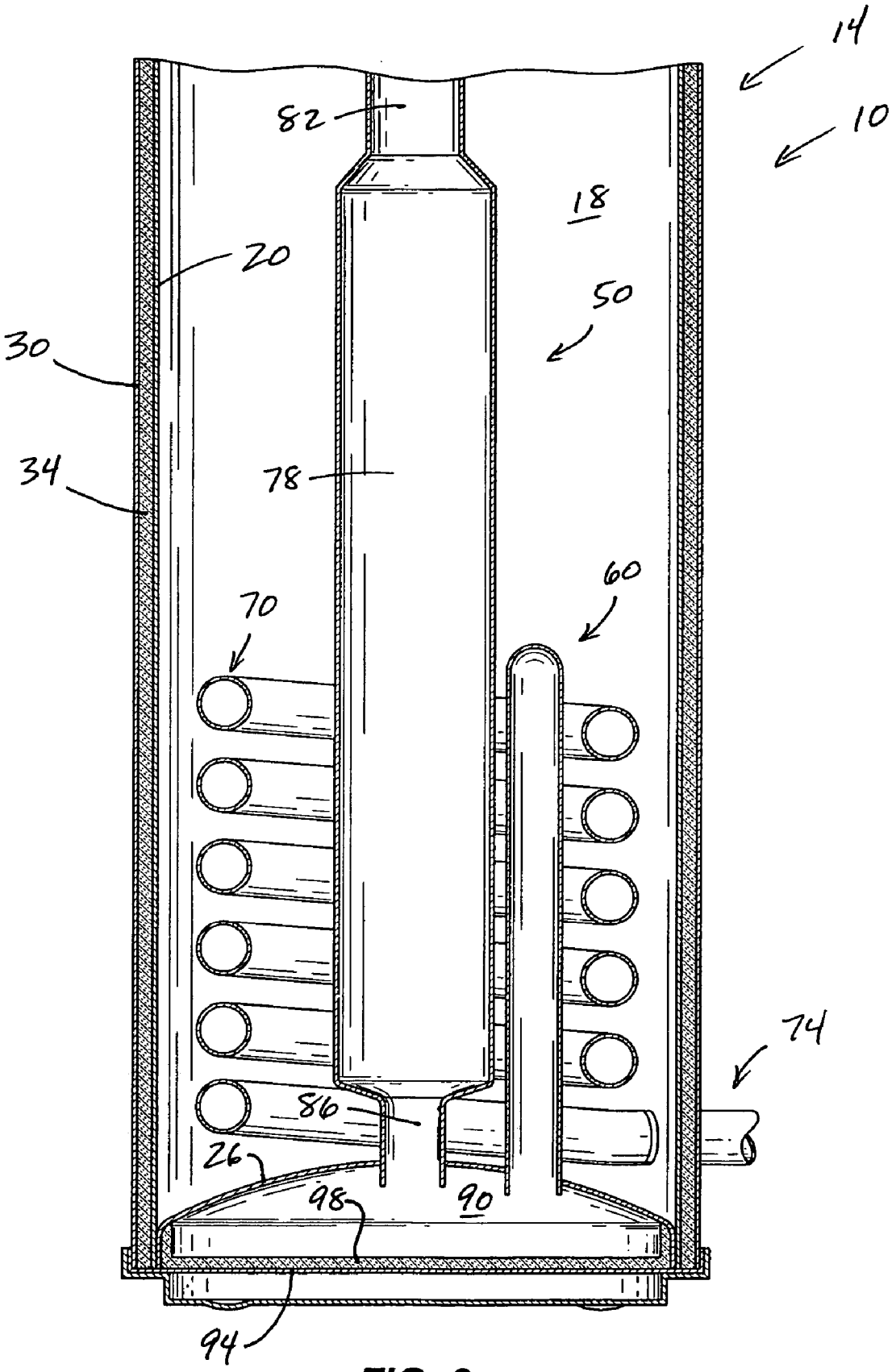
FIG. 2 is a sectional view of the water heater.

The lower end 86 of the tube 50 communicates with a transition chamber 90 (FIG. 2). In the preferred embodiment, the transition chamber 90 is formed in part by the bottom head 26, but it should be understood that the transition chamber 90 could be formed in any manner providing a chamber at the lower end of the combustion tube 50. The transition chamber 90 is also formed by a bottom cover 94 that closes off the bottom head 26 to provide the transition chamber between the bottom head 26 and the cover 94. Preferably, a layer of insulation 98 above the cover 94 reduces heat loss from the transition chamber 90 and also absorbs noise. As shown in FIG. 2, the insulation 98 preferably extends up the sides of the bottom head 26 to insulate the portion of the bottom head 26 not directly exposed to water. In the preferred embodiment of the invention, the transition chamber 90 has a volume of approximately 850 cubic inches, and a height of approximately five inches from the bottom cover 94 to the uppermost point of the bottom head 26. The lower end of the snorkel tube 60 communicates with the transition chamber 90. As shown in FIG. 2, the lower end of the combustion tube 50 and the lower end of the snorkel tube 60 extend a short distance, preferably about one inch, into the transition chamber 90 to provide additional noise attenuation.

Figure 3:
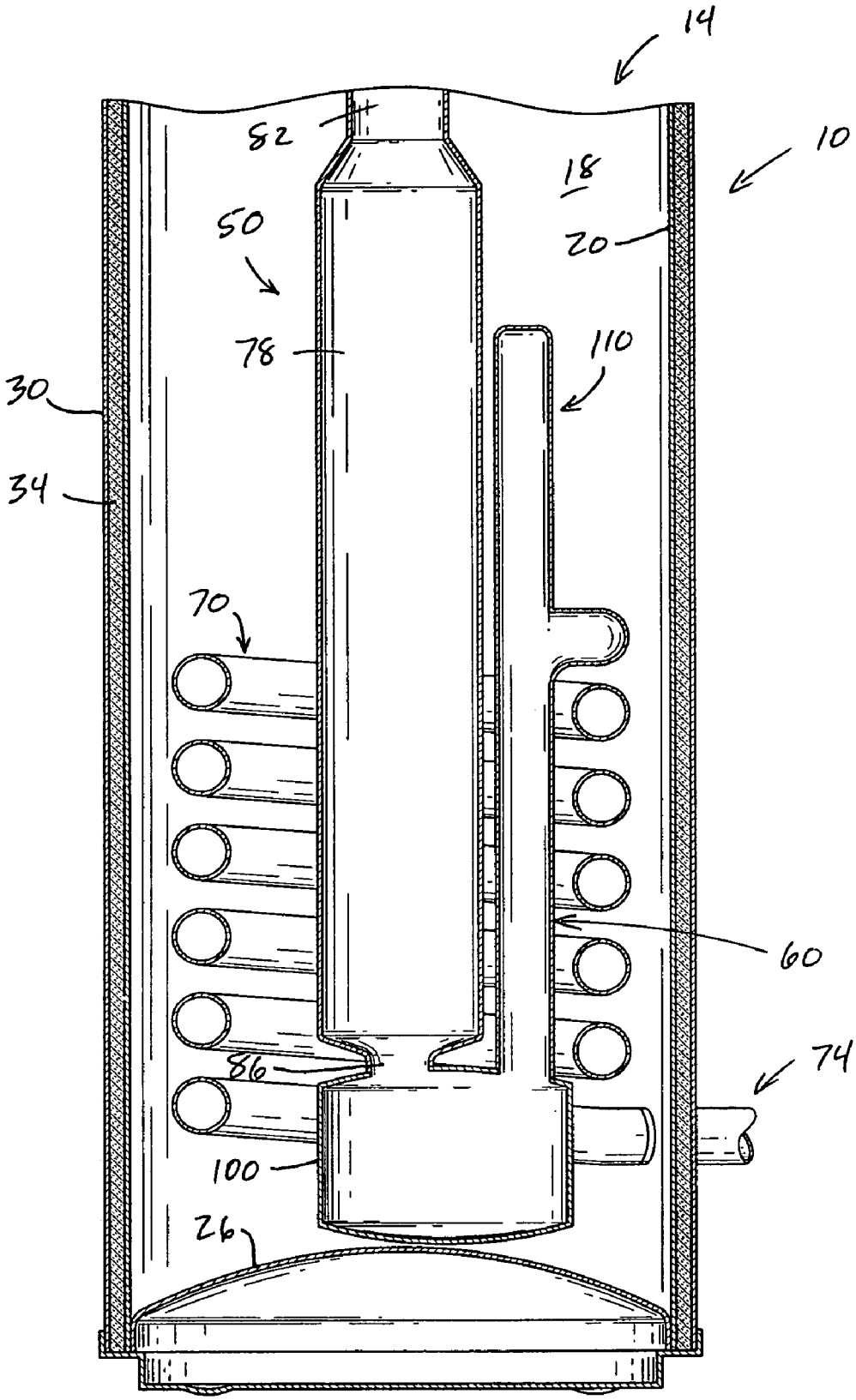
FIG. 3 is a sectional view of a water heater that is an alternative embodiment of the invention.

An alternative embodiment of the invention is shown in FIG. 3. In this embodiment, the transition chamber is formed by a pot 100 located entirely within the water chamber 18. The pot 100 can be made of a suitable metal, such as the same metal used for the combustion tube 50, for efficiently transferring heat to water in the chamber 18. The pot 100 is preferably generally cylindrical with a generally vertical central axis and has a domed top and bottom to resist water pressure. The lower end of the snorkel tube 60 communicates with the pot 100.

In the alternative embodiment, noise is further attenuated by a riser tube 110 at the upper end of the snorkel tube 60. It should be understood that the riser tube 10 could also be used in combination with the transition chamber 90 of the embodiment of FIG. 1, with another form of transition chamber, or without a transition chamber. The same can be said for the varying cross-section combustion tube 50, which can be used in combination with any transition chamber or riser tube, or alone.

The riser tube 110 preferably extends about fifteen inches above the coil 70. In the preferred embodiment of the invention, the riser tube 10 is circular in cross-section and has a diameter of approximately 2.5 inches.

Various other features and advantages of the invention are set forth in the following claims. While the invention has been described in the context of commercial water heaters, the claims are not intended to be so limited. The invention is readily applicable to residential water heaters if desired.

What is claimed is:

1. A water heater comprising:

a tank defining a water chamber for communication with a water inlet and a water outlet;

a combustion tube extending generally vertically through the water chamber and having upper and lower ends;

a coil surrounding the combustion tube and having upper and lower ends;

a snorkel tube communicating between the combustion tube and the upper end of the coil;

an exhaust outlet communicating with the lower end of the coil; and a gas burner firing into the upper end of the combustion tube;

the upper end of the combustion tube having a first cross-sectional area, a central portion of the combustion tube having a second cross-sectional areas greater than the first area, and the lower and of the combustion tube having a third cross-sectional area less than the second area.

2. The water heater of claim 1, wherein the third area is less than the first area.

3. The water heater of claim 2, wherein the second area is approximately 2.5 times the first area, and wherein the third area is approximately one-half the first area.

4. The water heater of claim 1, wherein the central portion of the combustion tube extends along a substantial portion of the length of the tube.

5. The water heater of claim 1, wherein the snorkel tube communicates with the combustion tube adjacent the lower end thereof.

6. The water heater of claim 5, wherein the upper end of the coil is located at approximately the vertical mid-point of the combustion tube.

7. A water heater comprising:

a tank defining a water chamber for communication with a water inlet and a water outlet;

a combustion tube extending generally vertically through the water chamber and having upper and lower ends;

a coil surrounding the combustion tube and having upper and lower ends;

a transition chamber communicating with the combustion tube near the lower end thereof, the transition chamber having a volume permitting expansion of combustion gases in the transition chamber;

a snorkel tube communicating between the transition chamber and the upper end of the coil;

an exhaust outlet communicating with the lower end of the coil; and a gas burner firing into the upper end of the combustion tube.

8. The water heater of claim 7 wherein the water heater has a bottom head partially defining the water chamber, and wherein the transition chamber is partially defined by the bottom head.

9. The water heater of claim 8 wherein the transition chamber is further defined by a bottom cover below the bottom head.

10. The water heater of claim 9 wherein the bottom cover is thermally insulated.

11. The water heater of claim 7 wherein the transition chamber is entirely within the water chamber.

12. The water heater of claim 11 wherein the transition chamber is generally cylindrical with a generally vertical central axis.

13. The water heater of claim 12 wherein the transition chamber has a domed top.

14. The water heater of claim 13 wherein the transition chamber has a domed bottom.

15. The water heater of claim 11 wherein the transition chamber is fabricated of a material having a high coefficient of heat transfer.

16. The water heater of claim 7 wherein the transition chamber has a volume of approximately 850 cubic inches.

17. A water heater comprising:

a tank defining a water chamber for communication with a water inlet and a water outlet;

a combustion tube extending generally vertically through the water chamber and having upper and lower ends;

a coil surrounding the combustion tube and having upper and lower ends;

a snorkel tube communicating between the combustion tube and the upper end of the coil;

a riser tube communicating with the snorkel tube and extending above the upper end of the coil;

an exhaust outlet communicating with the lower end of the coil; and a gas burner firing into the upper end of the combustion tube.

18. The water heater of claim 17 wherein the riser tube extends approximately 15 inches above the upper end of the coil.

19. The water heater of claim 17 wherein the riser tube also extends above the upper end of the snorkel tube.

20. A water heater comprising:

a tank defining a water chamber for communication with a water inlet and a water outlet;

a combustion tube extending generally vertically through the water chamber and having an upper end;

a coil surrounding the combustion tube and having inlet and outlet ends;

a second tube communicating between the combustion tube and the inlet end of the coil;

an exhaust outlet communicating with the outlet end of the coil;

a gas burner firing into the upper end of the combustion tube; and at least one expansion volume between the upper end of the combustion tube and the inlet end of the coil for attenuating noise.

21. The water heater of claim 20 wherein the expansion volume is in the combustion tube.

22. The water heater of claim 21 wherein the expansion volume includes the upper end of the combustion tube having a first cross-sectional area, a central portion of the combustion tube having a second cross-sectional areas greater than the first area, and the lower and of the combustion tube having a third cross-sectional area less than the second area.

23. The water heater of claim 20 wherein the expansion volume includes a transition chamber communicating with the combustion tube near the lower end thereof, and wherein the second tube communicates between the transition chamber and the inlet end of the coil.

24. The water heater of claim 20 wherein the expansion volume includes a riser tube communicating with the second tube.

25. The water heater of claim 24 wherein the riser tube extends above the second tube and above the inlet end of the coil.

* * * * *